US006053649A

United States Patent [19]

Ronai

[11] Patent Number: 6,053,649

[45] Date of Patent: Apr. 25, 2000

[54] WAX WARMER AND APPLICATOR APPARATUS

[76] Inventor: Christian Ronai, 1166 Bay Street, Suite 1104, Toronto, Ontario, Canada, M5S 2X8

[21] Appl. No.: 09/160,121

[22] Filed: Sep. 24, 1998

Related U.S. Application Data

[60] Provisional application No. 60/060,055, Sep. 24, 1997.

[51] Int. Cl.[7] ..... A46B 11/08

[52] U.S. Cl. ..... 401/1; 401/3; 401/119; 401/120; 401/185

[58] Field of Search ..... 401/1, 2, 119, 401/120, 184, 185, 3

[56] References Cited

U.S. PATENT DOCUMENTS

| | | | |
|---|---|---|---|
| 564,614 | 7/1896 | Gunn | 401/185 |
| 704,577 | 7/1902 | Puff | 401/185 X |
| 744,939 | 11/1903 | Reynolds | 401/120 X |
| 757,024 | 4/1904 | Clement | 401/185 |
| 1,575,152 | 3/1926 | Battista . | |
| 2,017,990 | 10/1935 | Ray | 401/120 X |
| 2,203,571 | 6/1940 | Hutchison | 401/120 |
| 2,809,772 | 10/1957 | Weisz . | |
| 3,369,854 | 2/1968 | Ferris | 401/120 X |
| 3,614,389 | 10/1971 | Malisza . | |
| 3,662,927 | 5/1972 | Cocks . | |
| 3,853,410 | 12/1974 | Busoni . | |
| 3,858,985 | 1/1975 | Fiveash . | |
| 3,952,921 | 4/1976 | Tanner . | |
| 4,096,973 | 6/1978 | Checko . | |
| 4,282,877 | 8/1981 | Mathews . | |
| 4,344,571 | 8/1982 | Kundig . | |
| 4,641,764 | 2/1987 | Faulkner . | |
| 4,667,084 | 5/1987 | Regge . | |
| 4,773,784 | 9/1988 | Mann . | |
| 4,958,951 | 9/1990 | Mann | 401/1 |
| 5,847,363 | 12/1998 | Debourg et al. | 401/1 X |

FOREIGN PATENT DOCUMENTS

| | | | |
|---|---|---|---|
| 497537 | 9/1954 | Italy | 401/120 |
| 649849 | 12/1962 | Italy | 401/184 |
| 7331 | 3/1906 | United Kingdom | 401/120 |

*Primary Examiner*—David J. Walczak
*Attorney, Agent, or Firm*—Baker & Daniels

[57] ABSTRACT

A system for heating and applying a depilatory wax to skin for the removal of unwanted hair includes an electric wax warmer, and a wax applicator able to store and carry a supply of warm liquid wax from the warmer to an area of the body. A compressible handle on the applicator allows the liquid wax to be forced out of the applicator and spread onto the skin in a very thin layer. The applicator is automatically refilled when placed back into the wax warmer and the compressible handle is released.

24 Claims, 4 Drawing Sheets

WAX WARMER AND APPLICATOR APPARATUS

CROSS REFERENCE TO RELATED APPLICATIONS

This application claims the benefit under Title 35, U.S.C. §119(e) of U.S. Provisional patent application Ser. No. 60/060,055, filed on Sep. 24, 1997.

FIELD OF THE INVENTION

The present invention relates to the application on human skin of warm liquid wax, for the purpose of removing unwanted facial and body hair, and in particular to a wax warmer and applicator apparatus.

BACKGROUND OF THE INVENTION

Many methods are used today for removing unwanted facial and body hair. The most common method is shaving where hair is removed near the skin by a blade scraped across the skin. Other methods include waxing where hair is pulled out of the skin by the roots, depilatories (cream or lotion) which chemically dissolve the hair, and laser or electrolysis where electricity is used to remove the hair.

In the case of waxing, two types of wax are common, namely hard wax and liquid wax. Hard wax as its name suggests is solid at room temperature but liquefies when heated. Once heated the wax is applied on the skin over the unwanted hair with a wooden spoon or spatula in a thick layer. The wax is then allowed to solidify embedding the hair. Once solidified, the wax is rapidly pulled away from the skin in one piece removing the trapped hair with it.

Liquid wax, more commonly use, is extremely thick at room temperature but gets thinner as it is heated. When heated to the desired temperature, the wax has the consistency of warm runny honey. During waxing a metal or wooden spatula is dipped into the wax, wiped on one side to remove excess wax and to reduce dripping, and is then horizontally carried to the area of the body to be waxed. The wax is applied to the skin in a thin layer in the direction of the hair growth. The spatula is then put down and a pre-cut strip of muslin or cotton cloth is pressed on the sticky wax. The strip is then pulled away in one quick motion in the opposite direction of the hair growth, pulling the hair out of the skin by the roots. The liquid wax is normally supplied to beauty salons in 14 oz metal cans. Prior to use, the cans are heated in an electric warmer to heat the wax to the desired temperature.

Unfortunately the above described technique of applying liquid wax is inconvenient. Specifically, when the can of wax is almost empty, the warmer needs to be tilted in order to allow an individual to reach the wax at bottom of the can. Often cans are disposed of at this point resulting in a significant amount of wasted wax. When adding a refill can into the warmer, there is typically a 40 minute wait for the wax to reach the desired temperature and consistency. In addition, the traditional spatula limits the amount of wax that can be carried and has the tendency to drip on the customer or on the floor. There is also a risk of burning the customer if the wax is applied too thick onto the skin. Because the wax on the body cools off rapidly, the muslin cloth has to be used after almost each dipping of the spatula, requiring the user to switch repeatedly between the spatula and the muslin cloth.

An alternative device to apply wax to an individual is disclosed in U.S. Pat. No. 4,958,951 to Inverness. This device consists of a plastic cartridge holding liquid wax that is heated in its own electric warmer. The cartridge has a roller head, and when the wax is "hot", the cartridge is taken out of the warmer, turned up-side down and rolled onto the area of skin to be waxed, dispensing wax as the head "rolls" along the skin. Once the wax has been dispensed, the cartridge is replaced in the warmer and a cloth is used as described above to remove the wax and the unwanted hair.

Unfortunately this device suffers other drawbacks in that it is not convenient for professional use because it creates significant packaging waste. In addition the roller head, which becomes covered with wax, cools off between applications, often making it very hard to roll and sticky at the beginning of each wax application thereby slowing the application process. Accordingly, improved devices to apply wax are desired.

It is therefore an object of the present invention to provide a novel wax warmer and applicator apparatus.

SUMMARY OF THE INVENTION

In accordance with one aspect of the present invention there is provided a wax warmer and applicator apparatus including a wax warmer having a heated reservoir and tray. The reservoir accommodates an inverted container of wax which drains into the reservoir as it is heated. The tray has an open top and is connected to the reservoir. A control valve allows wax to flow by gravity from the reservoir to the tray. A wax applicator rests generally horizontally in the tray and is retained by a U shaped wiper blade and a retainer. The applicator includes a hollow tubular member to hold liquid wax having a perforated slot formed in its under face. A compressible handle accommodates one end of the tubular member. An inflatable baffle extends into the tubular member, and inflates when the handle is compressed to discharge wax held into the tubular member via the perforated slot. Releasing the handle deflates the baffle thereby creating a vacuum within the tubular member allowing the tubular member to be refilled with liquid wax when the tubular member is immersed in liquid wax.

The wax warmer and applicator apparatus in accordance with the present invention has many advantages over the prior art. It allows the traditional method with a spatula to be used for precision work on areas like the face. The reservoir is easily refilled so that hot liquid wax is basically always available. The applicator is less prone to dripping because the wax is held and carried within a tubular member. The applicator is designed to quickly and easily spread the wax in a thin layer, reducing the risk of pain and burning. The applicator allows up to 10 times greater an area to be covered at a time, as compared to the conventional spatula method, dramatically reducing the time it takes to "wax" any area of the body.

BRIEF DESCRIPTION OF THE DRAWINGS

An embodiment of the present invention will now be described more fully with reference to the accompanying drawings in which.

DESCRIPTION OF THE PREFERRED EMBODIMENT

Figure 1:
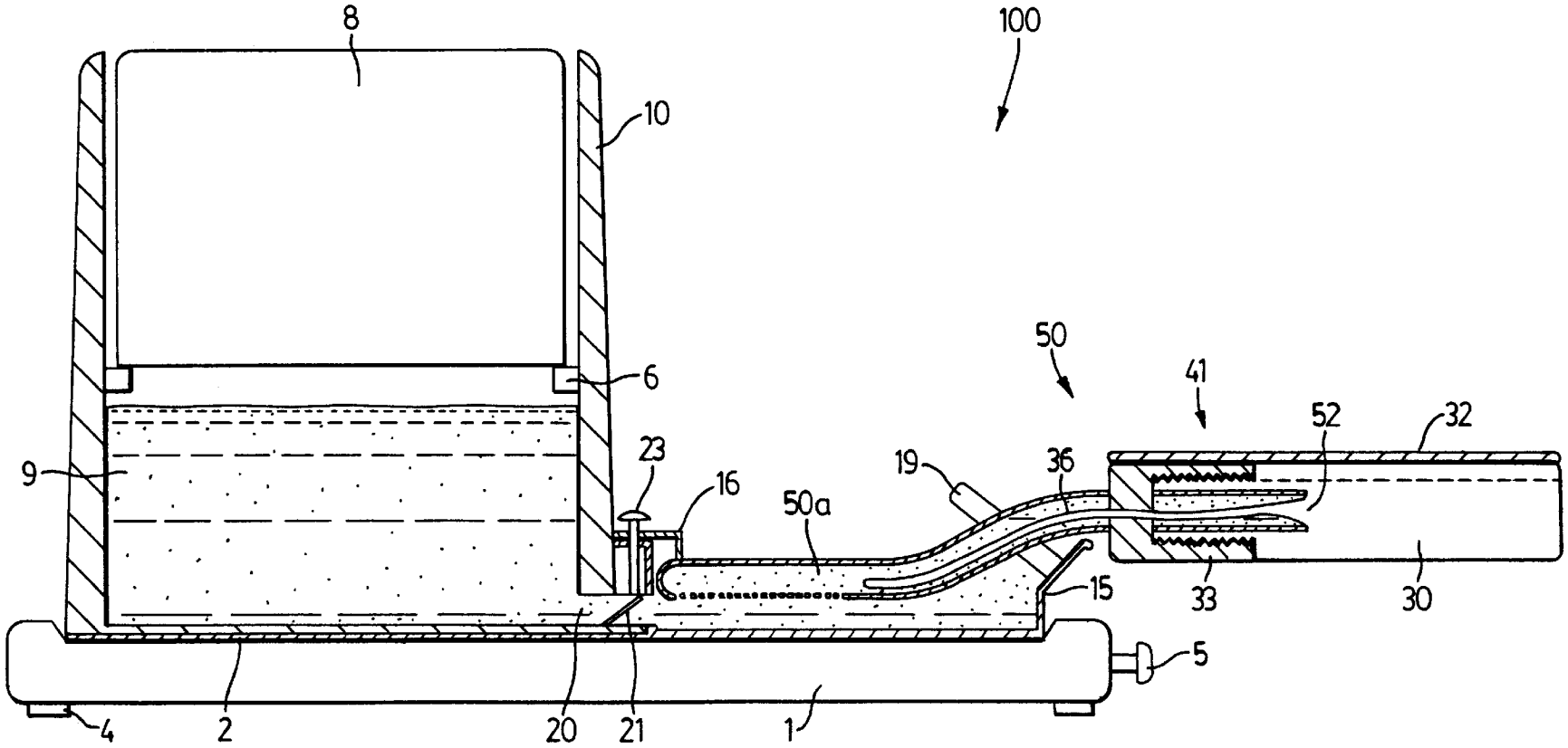
FIG. 1 is a cross sectional view of a wax warmer and applicator apparatus in accordance with the present invention.

Referring now to FIG. 1, a wax warmer and applicator apparatus is shown and is generally indicated by reference (100). The apparatus (100) includes an electric wax warmer (1) and an applicator (50). The wax warmer (1) includes a support supported by four anti-slip rubber pads (4) having a heating element (2) disposed on its upper surface. A thermostatic dimmer control (5) is mounted on the warmer (1) to precisely control the heating element. A cylindrical reservoir (10) and an opened top tray (15) are disposed on the support above the heating element (2). The reservoir (10) supplies hot liquid wax (9) to the tray (15) via a valved connecting hose (20). The valve (21) in the connecting hose (20) is actuable to an open condition when button (23) is pressed. Thus, when the level of wax in the tray (15) drops and an operator presses the button (23), the valve (21) opens allowing the wax to flow by gravity from the reservoir into the tray (15).

A refill container of wax (8) in the form of a sealed metal can of approximately 25 oz is placed upside down in the reservoir (10) after being perforated. Four stopper arms (6) within the reservoir support the container (8) so that it rests near the top of the reservoir (10) allowing the container to drain completely into the reservoir before being removed. Heat and gravity assist wax flow to the bottom of the reservoir (10). By maintaining wax in the reservoir (10) the reservoir is always ready to supply heated wax to the tray (15). Although not shown, covers may be provided to inhibit contaminants from falling into the reservoir (10) and the tray (15).

Figure 2A:
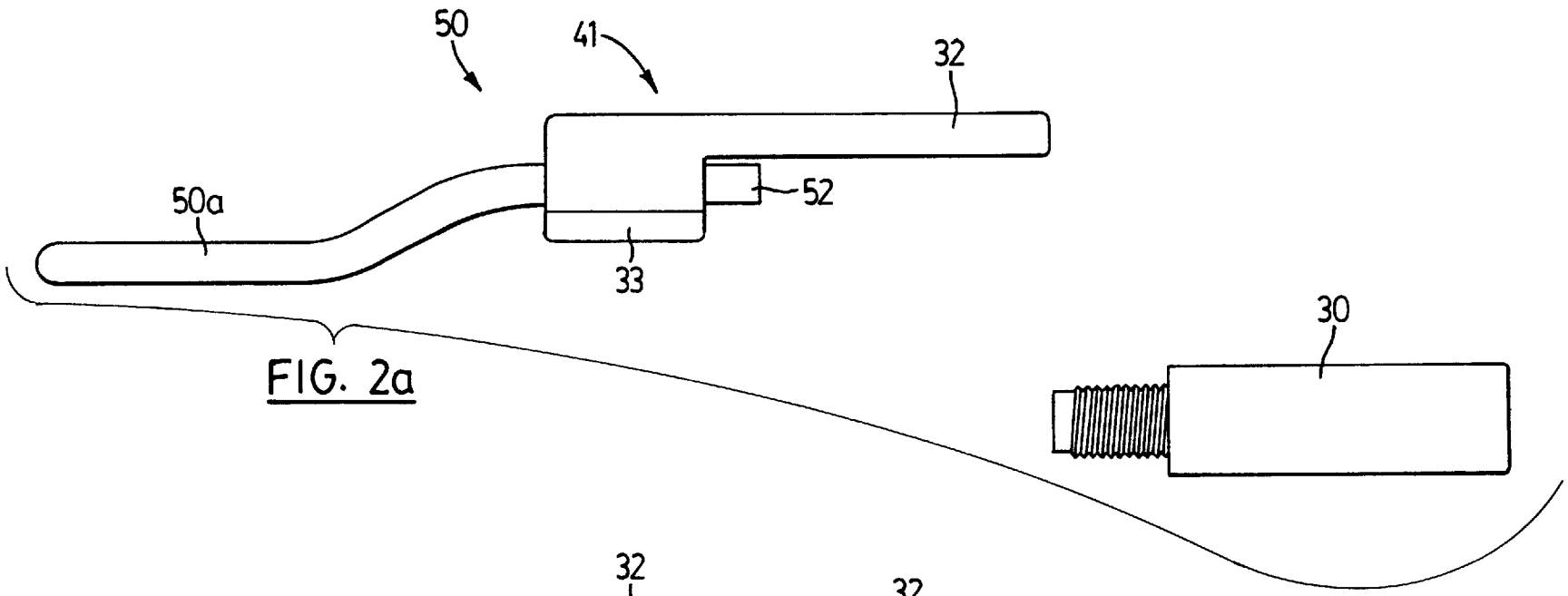
FIG. 2*a* is a partially exploded side elevation view of an applicator forming part of the apparatus of FIG. 1.
Figure 2B:
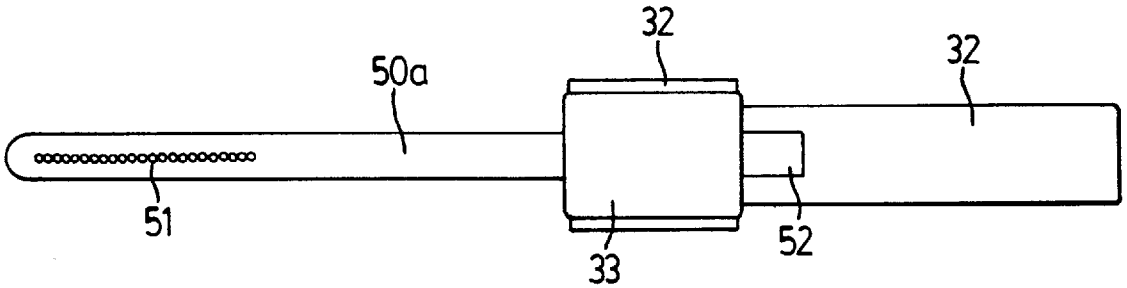
FIG. 2*b* is a bottom plan of the applicator.

The applicator (50) (best seen in FIGS. 2*a* and 2*b*) includes a hollow tubular member (50*a*) (of approximately ½ inch by ½ inch) that is closed at its distal end and open at its other end (52). The tubular member (50*a*) curves upwardly near its open end (52). The tubular member (50*a*) presents a generally planar, wax applicator surface having a perforated slot (51) or a series of adjacent small holes provided therein. The applicator (50) also includes a handle (41) coupled to the tubular member (50*a*) adjacent the open end (52). The handle (41) comprises a rigid cover (32), a screw cap (33) and a plastic bottle (30). In the present embodiment, the rigid cover (32), the screw cap (33) and the tubular member (50*a*) are of a one-piece construction formed of moulded plastic. Although not shown, a disposable sleeve may be put over the tubular member (50*a*) to avoid having it touch the skin of more than one person. Alternatively the tubular member (50*a*) can be wiped with a solvent before the applicator is used on another person.

An expandable baffle (36) similar to a rubber balloon is positioned within the tubular member (50*a*) and covers the opening (52). The plastic bottle (30) is filled with water and threadably engages the screw cap (33). The baffle (36) separates water in the bottle from liquid wax in the tubular member (50*a*) to inhibit the handle from getting hot and to inhibit the tubular member from getting cold.

Compressing the bottle (30) with one hand against the rigid cover (32) inflates the baffle (36) inside the tubular member (50*a*) because of water pressure, forcing wax or air out of the tubular member (50*a*) via the perforated slot (51). When the handle (41) is released, the bottle (36) returns it to its original shape due to the memory characteristics of the bottle material. The baffle in turn deflates forcing the water back into the bottle (30). A spring can be inserted into the bottle (30) to assist its return to the original shape if desired. When the baffle deflates a vacuum is created inside the tubular member (50*a*) so that wax is automatically sucked into the tubular member via the slot (51) when the tubular member is immersed in liquid wax.

Figure 3:
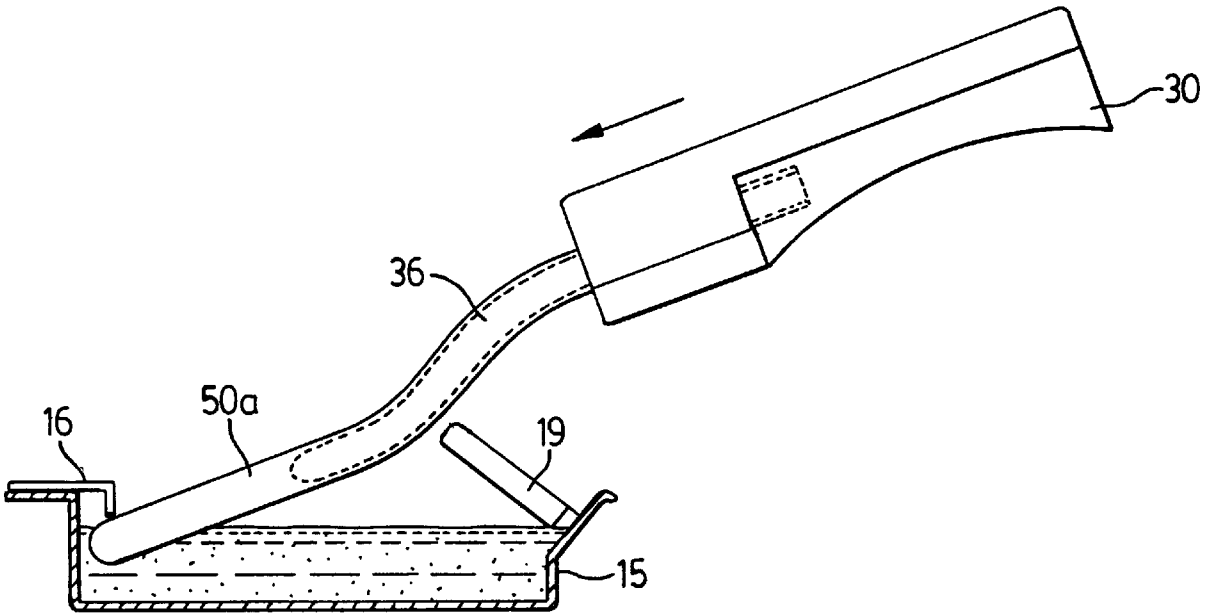
FIG. 3 is a side elevation view, showing the applicator being placed in the tray of a wax warmer forming part of the apparatus of FIG. 1 with the handle compressed and the baffle inflated.
Figure 4:
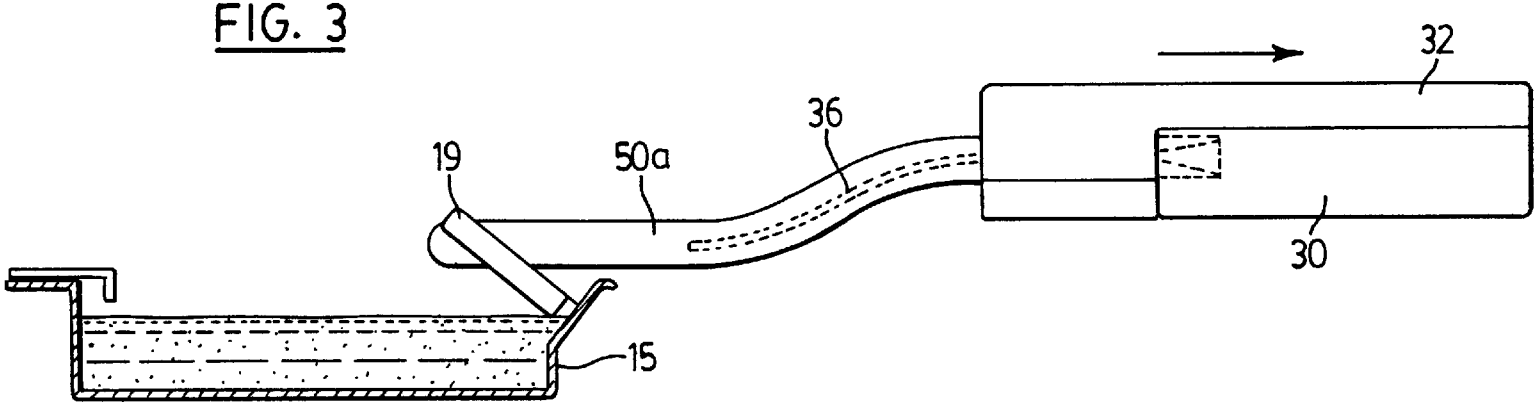
FIG. 4 is a side elevation view, showing the applicator being taken out of the tray with the applicator full of wax and the baffle deflated.
Figure 5:
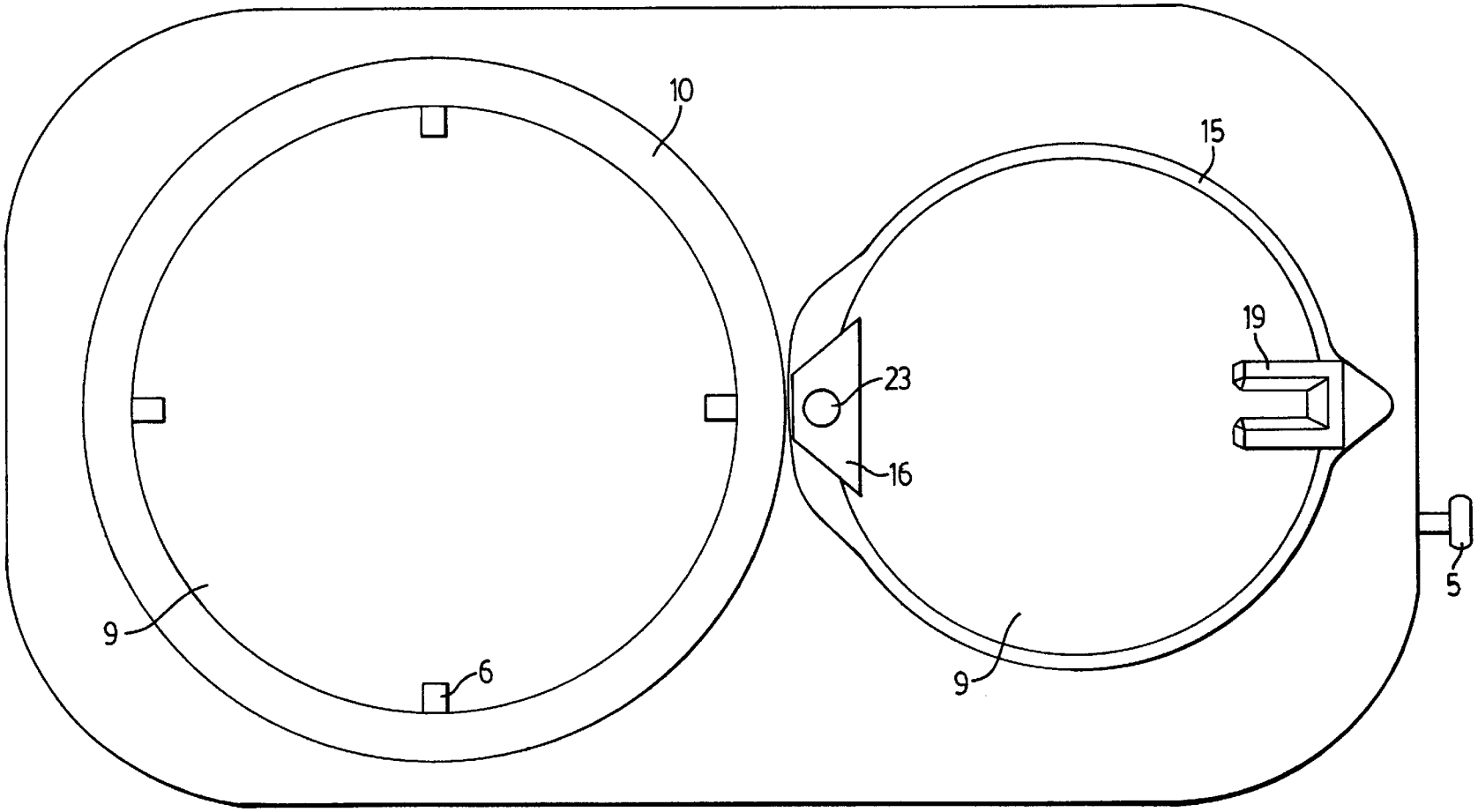
FIG. 5 is a top plan view of the wax warmer.

The tray (15) is equipped with a U-shaped wiper blade (19) which partially supports the applicator (50) in a horizontal position. FIG. 4 shows how the U-shaped wiper blade (19) cleans the two side faces and the wax applicator surface of the tubular member (50*a*), when the applicator (50) is horizontally pulled out of the tray. FIG. 3 demonstrates how the applicator is placed back into the tray (15) from above with the distal end of the tubular member (50*a*) engaging a retainer (16). When positioned in the tray as shown in FIG. 1, the applicator is balanced in the tray between the wiper blade (19) and the retainer (16) in a horizontal position.

In use, the applicator (50), with the handle (41) compressed, is placed in the tray (15) of the wax warmer as shown in FIG. 1, so that the perforated slot (51) of the tubular member (50*a*) is immersed in the wax, with the tubular member (50*a*) extending through the U shaped wiper blade (19) and with its distal end under the retainer (16). The handle (41) is then released so that the bottle (30) expands. As a result, the baffle (36) deflates creating a vacuum in the tubular member (50*a*) causing wax to be drawn therein. The applicator is then removed from the tray (15) using the U-shaped wiper blade to wipe wax from the tubular member (50*a*). The applicator is then carried to the area to be waxed with the slot (51) facing up.

To apply the wax, the tubular member (50*a*) is positioned relative to the skin to be waxed and tilted at about a 15 to 20 degree angle so that the leading edge of the wax applicator surface is spaced from the skin and so that the trailing edge of the wax applicator surface contacts the skin. The handle is then compressed to discharge wax and the applicator (50) is moved along the skin in the direction of the hair growth so that the trailing edge of the wax applicator surface applies pressure to the skin and spreads the wax thinly. The amount of wax dispensed is proportionate to the compression on the handle (41). During wax application, the applicator should be moving at all times and applying pressure on the hair and skin to apply a thin layer of wax to the skin. Many parallel strips of wax can be thinly applied to cover a large area before the applicator (50) needs refilling. The applicator (50) should be replaced into the tray (15) before removing the pressure on the handle (41). Once the handle (41) is released with the applicator in the tray, the tubular member (50*a*) is refilled with liquid wax in about 3 seconds, faster than removing the hair with the muslin cloth.

For small areas where precision is needed, like eyebrows and upper lips, the tray (15) allows warm wax to be carried using a spatula and applied in the conventional manner.

Those skilled in the art will appreciate that the present invention provides a very fast, efficient and economical wax warmer and applicator apparatus which easily applies a thin layer of liquid wax onto a large area of skin and hair.

Other modifications and variations may be made to the present invention without departing from the spirit and scope thereof. Although the wax warmer and applicator apparatus has been described above with an expandable baffle (36) to control the pressure inside the applicator (50), other mechanical methods can be employed to control the flow of the wax into and out of the applicator. For example a hypodermic syringe connected to a trigger control system can be used. Also, although the bottle has been described as being filled with water, it should be appreciated by those skilled in the art that the bottle can be filled with other media. Although the tubular member (50*a*) has been described as forming about a 15–20 degree angle in use, those of skill in the art will appreciate that the tubular member (50*a*) can be oriented as desired provided pressure is applied to the skin to spread the wax. Although the tubular member (50*a*) has been described as being integral with the rigid cover (32) and the screw cap (33), it should be appreciated that the tubular member (50*a*) may be separate from and releasably attached to the screw cap. This will allow the tubular member (50*a*) to be replaced and/or disposed of after use.

What is claimed is:

1. A wax warmer and applicator apparatus comprising:

a tray to hold heated liquid wax; and an applicator removably supported by said tray for applying liquid wax onto a subject, said applicator including:

an elongate, hollow tubular member to hold liquid wax and having a generally planar, perforated wax applicator surface;

a handle coupled to said tubular member; and a pressurizable chamber in fluid communication with said tubular member, said chamber being depressurizable to create a vacuum in said tubular member thereby to draw wax from said tray into said tubular member via perforations in said wax applicator surface and being pressurizable to discharge wax from said tubular member via said perforations.

2. An apparatus as defined in claim 1 wherein said chamber is compressible and is pressurized and depressurized by manually compressing and releasing said chamber.

3. An apparatus as defined in claim 2 wherein said chamber is a compressible bottle coupled to an open end of said tubular member.

4. An apparatus as defined in claim 3 wherein said handle includes a rigid cover member integrally formed with said tubular member, said bottle being disposed beneath said cover member to facilitate manual compression of said bottle when said applicator is grasped via said handle.

5. An apparatus as defined in claim 4 wherein said bottle is releasably coupled to the open end of said tubular member.

6. An apparatus as defined in claim 5 wherein said bottle threadably engages said tubular member.

7. An apparatus as defined in claim 3 wherein said pressurizable chamber further includes an expandable baffle disposed in said tubular member and being in fluid communication with said bottle, said baffle being pressurized and depressurized when said bottle is compressed and released.

8. An apparatus as defined in claim 1 wherein said wax applicator surface has a longitudinally extending slot formed therein, said perforations being disposed at spaced locations along said slot.

9. An apparatus as defined in claim 1 further comprising a heated reservoir to hold a supply of heated liquid wax, said reservoir delivering liquid wax to said tray.

10. An apparatus as defined in claim 9 wherein said reservoir is connected to said tray via a valved connecting hose.

11. An apparatus as defined in claim 10 wherein the valve in said connecting hose is manually actuable.

12. An apparatus as defined in claim 9 wherein said reservoir is heated and is configured to receive and support a container of liquid wax to allow said container to drain by gravity into said reservoir.

13. An apparatus as defined in claim 12 wherein said tray is heated.

14. An apparatus as defined in claim 13 wherein said reservoir is generally cylindrical and includes a plurality of stopper arms on an inner wall thereof intermediate the height of said reservoir, said stopper arms supporting said container.

15. An apparatus as defined in claim 13 wherein said tray and reservoir are disposed on a support having a heating element thereon, said heating element heating said tray and reservoir.

16. An apparatus as defined in claim 1 wherein said tray further includes a wiping blade to wipe excess wax from said wax applicator surface when said applicator is removed from said tray.

17. An apparatus as defined in claim 16 wherein said wiping blade is generally U-shaped.

18. An applicator for applying liquid wax onto a subject comprising:

an elongate, hollow tubular member to hold liquid wax and having a generally planar, perforated wax applicator surface;

a handle coupled to said tubular member; and a pressurizable chamber in fluid communication with said tubular member, said chamber being depressurizable to create a vacuum in said tubular member to draw wax from said tray into said tubular member via perforations in said wax applicator surface and being pressurizable to discharge wax from said tubular member via said perforations.

19. An applicator as defined in claim 18 wherein said chamber is compressible and is pressurized by manually compressing and releasing said chamber.

20. An applicator as defined in claim 19 wherein said chamber is a compressible bottle coupled to an open end of said tubular member.

21. An applicator as defined in claim 20 wherein said handle includes a rigid cover member integrally formed with said tubular member, said bottle being disposed beneath said cover member to facilitate manual compression of said bottle when said applicator is grasped via said handle.

22. An applicator as defined in claim 21 wherein said bottle is releasably coupled to the open end of said tubular member.

23. An applicator as defined in claim 20 wherein said pressurizable chamber further includes an expandable baffle disposed in said tubular member and being in fluid communication with said bottle, said baffle being pressurized and depressurized when said bottle is compressed and released.

24. An applicator as defined in claim 18 wherein said wax applicator surface has a longitudinally extending slot formed therein, said perforations being disposed at spaced locations along said slot.

* * * * *